United States Patent [19]

Parkin

[11] Patent Number: 4,464,869

[45] Date of Patent: Aug. 14, 1984

[54] DRY WALL BUILDING PANEL REPAIR DEVICE

[76] Inventor: Robert L. Parkin, 9 Old Field Rd., Huntington, L.I., N.Y. 11743

[21] Appl. No.: 426,716

[22] Filed: Sep. 29, 1982

[51] Int. Cl.[3] ..... E04G 23/02

[52] U.S. Cl. ..... 52/173 R; 52/514

[58] Field of Search ..... 52/514, 461, 464, 716, 52/717, 718, 416, 417, 420, 173; 428/63; 156/94, 98

[56] References Cited

U.S. PATENT DOCUMENTS

| | | | |
|---|---|---|---|
| 417,334 | 12/1889 | Pennycook | 52/461 |
| 2,624,689 | 1/1953 | Peters et al. | 156/94 |
| 3,494,820 | 2/1970 | Shewmake | 428/63 |
| 3,576,091 | 4/1971 | Shull et al. | 52/417 |
| 3,717,970 | 2/1973 | Rosenblum | 52/514 |
| 3,874,505 | 4/1975 | Mirarchi et al. | 52/514 |
| 4,335,554 | 6/1982 | Nicholson | 52/514 |

FOREIGN PATENT DOCUMENTS

| | | | |
|---|---|---|---|
| 579066 | 7/1946 | United Kingdom | 52/464 |

*Primary Examiner*—John E. Murtagh

*Attorney, Agent, or Firm*—Nims Howes Collison & Isner

[57] ABSTRACT

This invention is directed to method and apparatus for repairing damaged dry wall building panels and includes a selectively constituted repair strip operative to properly position the marginal edges of a redefined opening and replacement panel segment to effect coplanar positioning of the latter relative to undamaged wall sections.

5 Claims, 5 Drawing Figures

DRY WALL BUILDING PANEL REPAIR DEVICE

This invention relates to a method and apparatus for repair of so-called "dry wall" interior building panels and, more particularly, to a repair kit and constituents thereof that facilitate the repair of damage to "dry wall" interior building panels.

Because of the escalating expense that has been characteristically attendant the construction of lath base, plaster surfaced interior building wall construction, the years since World War II have seen a progressively increasing utilization and reliance upon so-called "dry wall" interior building panels for interior wall and space definition both in private dwellings and in commercial installations. Such "dry wall" construction conventionally employs 4×8 gypsum board panels, usually called "sheetrock" or the like, having a gypsum core disposed intermediate cardboard sheeting and with the joints between adjacent panels masked by an overlaying perforated paper tape submerged in a spackling type compound. While the impetus behind the shift to such "dry wall" construction has been realistically founded upon the markedly reduced costs of installation thereof, one deleterious consequence has been the provision of an interior wall structure that is particularly subject to damage because of its inherent lack of resistance to impact forces or the like.

The susceptibility to damage of such "dry wall" interior construction has been accompanied by a concomitant and continually escalating cost of professional repair of such impact damaged "dry wall" panels and with a concomitant demand for facilitated home owner type repair thereof. Such repair conventionally involves a redefinition of the damaged area to provide straight marginal edges therefore, substitution of a complementally dimensioned new wall section for the redefined damaged area, and a retaping and respackling of the new interfacially abutting marginal edges to provide a smooth and unblemished wall surface preparatory to repainting thereof. While such broad repair steps are conventional in nature and are basically necessitated by the character of the building materials employed, considerable difficulties have been encountered through the use of clips or other noncontinuous elements in properly positioning the replacement panel section vis-a-vis the marginal defining edges of the redefined damaged area so as to assure coplanar alignment thereof and appropriate coplanar positioning of the interfacially abutting marginal edge portions thereof so as to facilitate tape application thereto and subsequent spackling and finishing operations.

This invention may be broadly described as an improved repair kit assembly to facilitate home owner repair of damaged "dry wall" panels. In its broader aspects, it includes provision of a selectively constituted repair strip, severable to appropriate length at the point of use, that is operative to effectively properly position the marginal edges of the redefined opening and of a replacement panel segment to effect coplanar positioning of the replacement panel relative to the wall and thus readily permit application of the perforated tape and subsequent spackling over the abutting marginal edges to provide a smooth and unbroken repaired wall surface. In its more narrow aspects, the subject invention includes the provision of a selectively constituted repair strip having a relatively rigid back portion adapted to be disposed behind the marginal edges of the redefined opening and the replacement panel to position the latter in coplanar relation with the former and an integral extending center portion adapted to extend outwardly intermediate the abutting marginal edges of the redefined opening of the wall panel and the replacement panel and to be deformed into adhesively secured relation with the adjacent coplanar outer surfaces thereof.

Among the advantages of the subject invention is the provision of an improved method for effecting the repair of damaged "dry wall" interior building panels and the provision of a simple and inexpensive repair kit that includes a selectively constituted repair strip that facilitates home owner repair of "dry wall" panels.

The primary object of this invention is the provision of an improved method and device for effecting repair of damaged "dry wall" type building panels.

A further object of this invention is the provision of an improved method and device for repair of "dry wall" building panels that can be compatably finished by conventional tape and spackle techniques.

Still another object of this invention is the provision of an improved device in the form of a selectively constituted repair strip for effecting repair of damaged "dry wall" type building panels.

Other objects and advantages of the subject invention will become apparent from review of the following portions of this specification and from the appended drawings which illustrate, in accord with the mandate of the patent statutes, a presently preferred embodiment incorporating the principles of this invention.

DESCRIPTION OF THE PREFERRED EMBODIMENT

Figure 1:
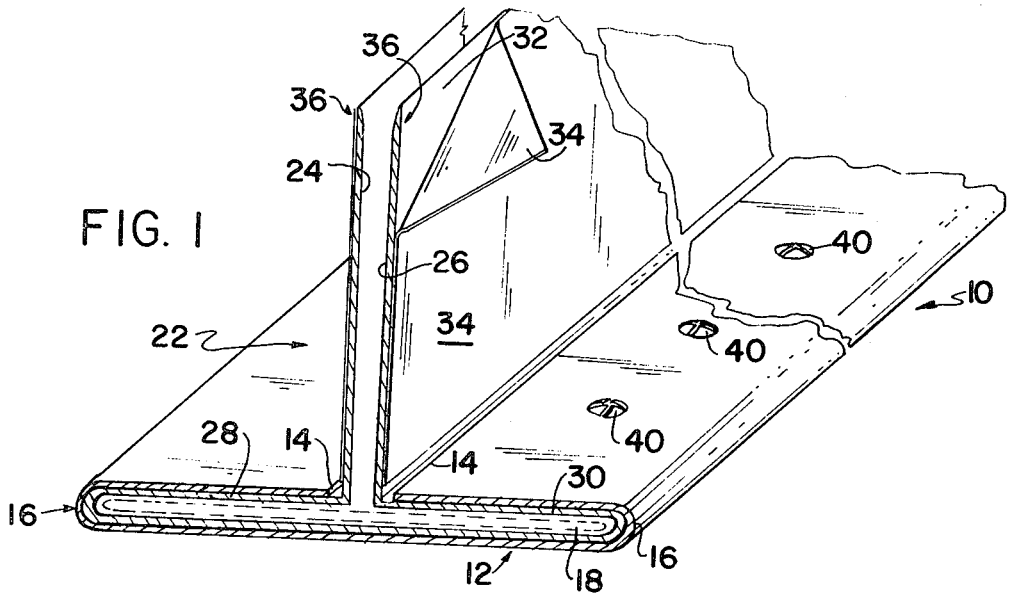
FIG. 1 is an oblique view of a "dry wall" repair strip incorporating the principles of this invention.

Referring initially to FIG. 1 of the drawings, there is provided an improved "dry wall" panel repair device, generally designated 10, in the form of an elongate strip of compositely constituted material having a cross-sectional configuration in the nature of an inverted "T". The base portion thereof, generally designated 12, is formed of an elongate strip of relatively hard sheet metal or the like, preferably relatively hard temper, i.e. H16 or H18 light gauge aluminum sheet, suitably 007–015 inches thick, or a heavy gauge hard rolled aluminum foil, suitably 004–006 inches thick, having its elongate marginal edges 14 folded back, as at 16, to form a relatively rigid double thickness backing strip. The rigidity of said base portion 12 may be determined entirely by the thickness and temper of the metal employed or it may be supplemented by incorporation of a rigid core material as indicated by the dotted lines 18. It is contemplated that the repair kit will include several elongate repair strips 10 of varying transverse dimension and base portion rigidity for selective use thereof in accord with the size and location of the area to be repaired.

The center or perpendicularly extending portion of the strip 10, generally designated 22, is formed of a pair of separable strips of tapes 24 and 26, suitably of heavy paper or of resinous film material. The remote marginal edge portions 28 and 30 of the tape strips 24 and 26 respectively are firmly anchored intermediate the folded back portions 16 of the base 12. If desired the center portion 22 of the strip 10 may be formed of a single strip of tape material having its intermediate body portion folded back upon itself in the nature of an inverted "T" and with the base portion thereof disposed within the folded back portions 16 of the base 12 of the metal backing where it is not only firmly anchored therebetween but also serves to supplement the rigidity of such base portion 12.

The outwardly extending tape strips 24 and 26 are coated on their outwardly facing surfaces with a pressure sensitive contact adhesive coating 32 covered by a removable paper strip 34. As best shown in FIG. 3, the exposed marginal edges of the tapes 24 and 26 are tapered as at 36 to facilitate, as will become later more apparent, the feathering of the joint adjacent the abutting marginal edges of the redefined damaged wall area and the replacement panel section.

Figure 4:
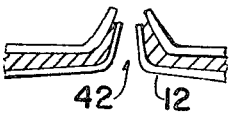
FIG. 4 is an enlarged schematic view of the positioning protrusions included in the repair strip and shown in FIG. 1.

As best shown in FIGS. 1 and 4, the base portion 12 of the strip 10 includes a plurality of selectively located jagged protrusions 40 which may be constituted of discrete tack-like members but which are preferably formed by punching small holes 42 in the assembled base portion 12 as shown in FIG. 4.

Figure 2:
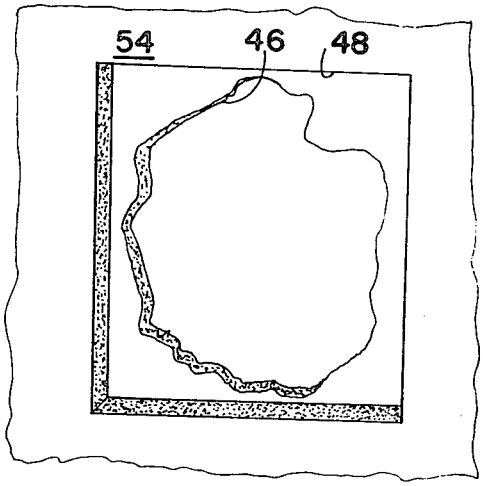
FIG. 2 schematically illustrates a damaged area in a "dry wall" building panel and the initial steps involved in the repair thereof.
Figure 3A:
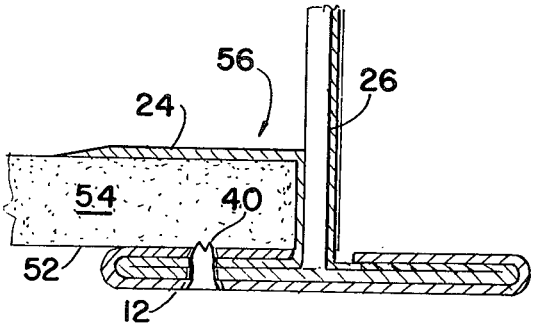
FIGS. 3A and 3B are generalized sectional views of the installation steps for the repair strip shown in FIG. 1.
Figure 3B:
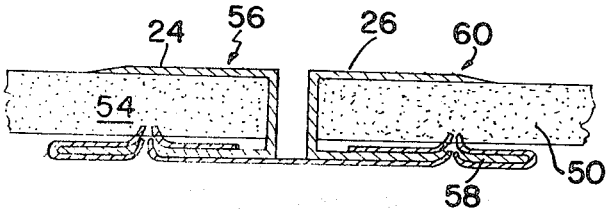

The method of repair of a damaged "dry wall" or "sheet rock" panel is schematically shown in FIGS. 2, 3A and 3B. By way of example, the damaged area may be considered as an irregular hole indicated by the dotted line 46 on FIG. 2. First, the damaged area is enlarged to define a straight edged aperture, such as a square or rectangle 48. While such redefined damaged area is preferably of rectilinear shape, curved marginal edges can be accommodated, where necessary, by cutting appropriately located sectors in the base portion 12 of the strip. A replacement or patch panel 50 of perimetric dimension shaped sized to closely fit within the redefined damaged area is then prepared. Appropriate segments of the repair strip 10 of a length to be disposed within the defining marginal edges of the redefined damaged area are then severed from the elongate supply thereof. One of such strips is then placed along the marginal edge of the redefined hole, as illustrated in FIG. 3A, with one side of the base portion 12 thereof disposed in interfacial engagement with the back surface 52 of the existing wall panel 54, and with the protrusions 40 thereon pressed firmly into the cardboard or paper facing of such panel. While maintained in such compressive engagement, the paper covering for the strip 24 is removed and the strip 24 is pressed into adhesively secured relation to the edge and outer surface of the panel as shown at 56. Such operation is repeated for each of the marginal edges of the redefined damage area to thereby provide a relatively rigid perimetric shelf or shoulder, compositely constituted by the remaining portions 58 of the bases 12 of the strips, disposed at the back of the redefined damage area. The replacement of patch panel 50 is then placed into the opening, gently pressed against the exposed portions 58 of the base 12 of the wall mounted strips and secured in position by folding back the tapes 26 into adhesively secured relation with the edge and outer surface of the patch as shown at 60 in FIG. 3B.

The joint between the mounted replacement panel 50 and the wall may now be finished by conventional tape application and spackling.

What is claimed is:

1. Dry wall repair strip means severable into appropriate lengths at the locus of use thereof, comprising an elongate rigid planar base portion having a pair of parallel marginal edges disposed substantially equidistant from the longitudinal center line thereof, a pair of elongate tape members anchored to said base portion, extending normal thereto along said longitudinal center line and individually foldable into parallel spaced relation with said base portion, a coating of pressure sensitive adhesive material selectively disposed on the outwardly facing surfaces of each of said tape members, and a removable covering for each said adhesive material coated portion of said tape members to operatively expose said pressure sensitive adhesive coating thereon.

2. Dry wall repair strip means as set forth in claim 1, wherein the exposed marginal edges of said tape members are cross-sectionally tapered.

3. Dry wall repair strip means as set forth in claim 1, wherein said base portion is formed of an elongate strip of metal sheet material having its marginal edges folded back and disposed parallel to and adjacent said longitudinal center line to provide a double thickness of interfacially abutting metal sheet material on either side of said center line.

4. Dry wall repair strip means as set forth in claim 3, wherein said tapes are anchored intermediate said folded back portions of said base portion.

5. Dry wall repair strip means as set forth in claim 1, including relatively sharp edged means protruding from the surface of said base portion disposed adjacent to said tape members.

* * * * *